US006659222B1

(12) United States Patent
Allman

(10) Patent No.: US 6,659,222 B1
(45) Date of Patent: Dec. 9, 2003

(54) MULTI-CHAMBERED MUFFLER

(75) Inventor: James R. Allman, North Vernon, IN (US)

(73) Assignee: ArvinMeritor, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/914,905

(22) PCT Filed: Mar. 3, 2000

(86) PCT No.: PCT/US00/05673

§ 371 (c)(1),
(2), (4) Date: Oct. 30, 2001

(87) PCT Pub. No.: WO00/52312

PCT Pub. Date: Sep. 8, 2000

Related U.S. Application Data

(60) Provisional application No. 60/122,881, filed on Mar. 5, 1999.

(51) Int. Cl.[7] ..... F01N 7/18

(52) U.S. Cl. ..... 181/282; 181/281; 181/268; 181/269; 181/272; 181/275

(58) Field of Search ..... 181/282, 281, 181/264, 267, 268, 269, 272, 275, 227, 228, 249, 251, 255

(56) References Cited

U.S. PATENT DOCUMENTS

| | | | | | |
|---|---|---|---|---|---|
| 3,125,182 | A | * | 3/1964 | Earley | 181/265 |
| 4,164,266 | A | | 8/1979 | Collin et al. | 181/250 |
| 4,700,806 | A | | 10/1987 | Harwood | 181/282 |
| 4,941,545 | A | | 7/1990 | Wilcox et al. | 181/282 |
| 5,012,891 | A | * | 5/1991 | Macaluso | 181/282 |
| 5,147,987 | A | | 9/1992 | Richardson et al. | 181/264 |
| 5,229,557 | A | | 7/1993 | Allman et al. | 181/282 |
| 5,597,986 | A | * | 1/1997 | Harwood et al. | 181/282 |
| 5,816,361 | A | * | 10/1998 | Gerber | 181/243 |
| 5,859,394 | A | * | 1/1999 | Seehaus et al. | 181/282 |
| 6,135,237 | A | * | 10/2000 | Allman | 181/282 |
| 6,164,412 | A | * | 12/2000 | Allman | 181/272 |
| 6,341,664 | B1 | * | 1/2002 | Gerber | 181/282 |

* cited by examiner

*Primary Examiner*—Robert E. Nappi
*Assistant Examiner*—Edgardo San Martin
(74) *Attorney, Agent, or Firm*—Barnes & Thornburg

(57) ABSTRACT

A muffler includes an outer shell which defines a chamber. A baffle is positioned in the chamber. A pair of plates cooperate with the baffle to partition the chamber into subchambers.

28 Claims, 4 Drawing Sheets

MULTI-CHAMBERED MUFFLER

This application claims the benefit of provisional application No. 60/122,881 filed on Mar. 5, 1999.

BACKGROUND AND SUMMARY OF THE INVENTION

This invention relates to exhaust systems and, in particular, to mufflers for quieting the exhaust noise of vehicle engines. More particularly, this invention relates to mufflers having outer shells and passageways for conducting exhaust product through a region defined by the outer shells to quiet noise associated with the exhaust product.

In accordance with the present invention, a muffler is created by joining two half shells at their peripheries to form an internal chamber therebetween. A baffle plate extends between the two shells to divide the chamber into two subchambers. The baffle is provided with an aperture into which a pair of inner plates are inserted to further divide the subchambers. An inlet and an outlet pipe extend through the shells and are supported by additional apertures in the baffle. The pair of inner plates define a passageway between two of the subchambers as well as a pair of tuning chambers between subchambers for noise reduction.

Other features of the present invention will become apparent to those skilled in the art from the following detailed description of preferred embodiments of the invention exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
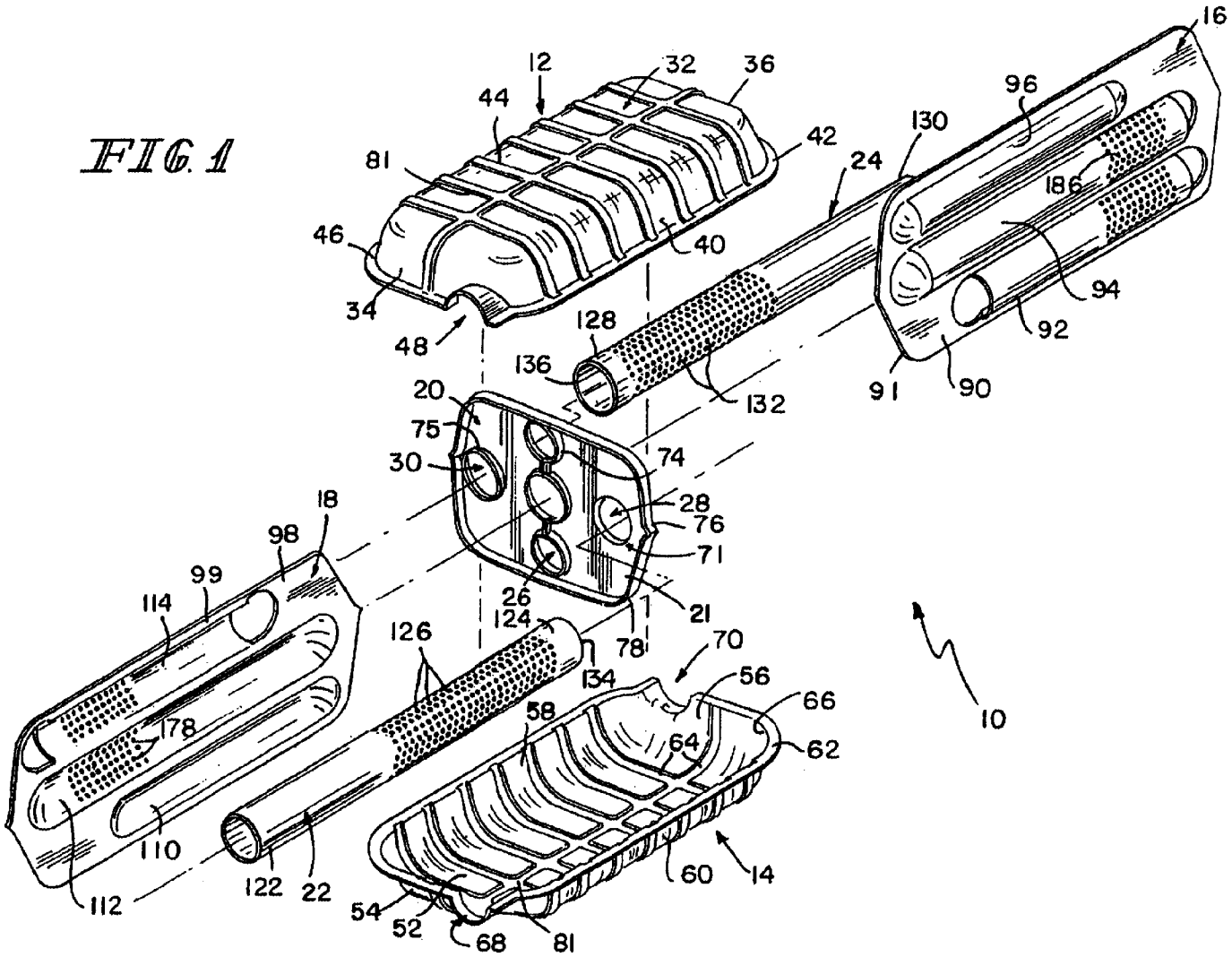
FIG. 1 is a perspective exploded view of a muffler including horizontal top and bottom outer shells, vertical first and second inner plates, an inlet tube, an outlet tube and a baffle plate.

A stamp-formed muffler 10 according to the present invention is shown in FIG. 1. Muffler 10 includes a stamped top outer shell 12, a stamped bottom outer shell 14, a stamped vertical first inner plate 16, a stamped vertical second inner plate 18, a vertical baffle plate 20, an inlet tube 22, and an outlet tube 24 as shown in FIG. 1.

Figure 2:
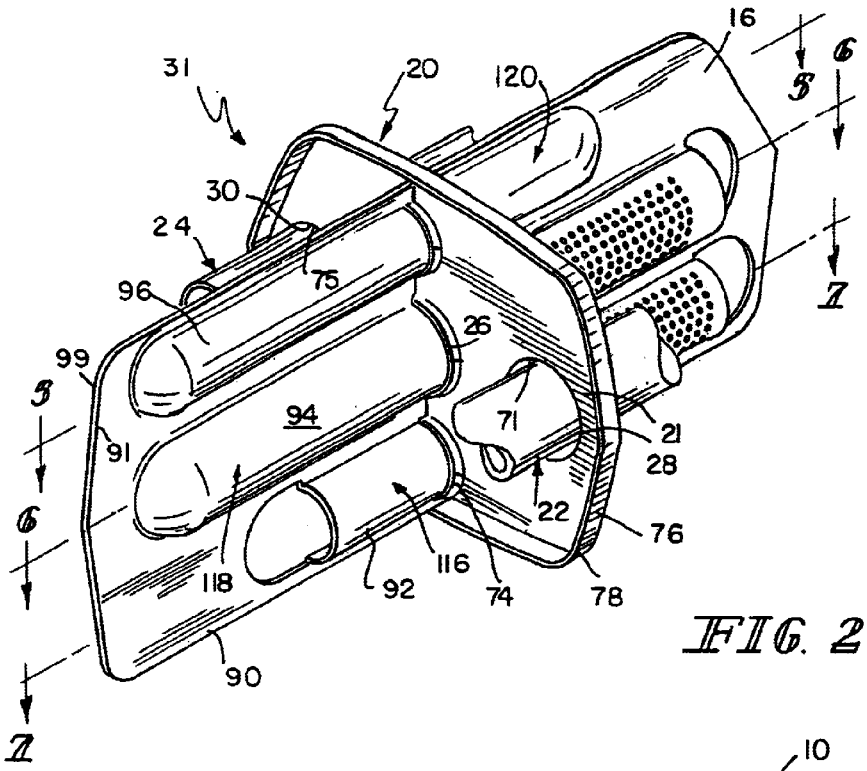
FIG. 2 is a perspective view of the baffle plate, the vertical first and second inner plates, the inlet tube, and the outlet tube, with portions broken away, showing the vertical first and second inner plates mated together and positioned to extend through the baffle plate to form a lower tuning throat, a middle conductor tube, and an upper tuning throat, the inlet tube positioned to extend through the baffle plate, and the outlet tube positioned to extend through the baffle plate so that the vertical first and second inner plates, the baffle, the inlet tube, and the outlet tube cooperate to form a subassembly.

Vertical first and second inner plates 16, 18, inlet tube 22, and outlet tube 24 are positioned to extend through baffle plate 20 to form a subassembly 31 as shown in FIG. 2. Top and bottom outer shells 12, 14 define a chamber 33. Subassembly 31 is positioned between top and bottom outer shells 12, 14 and partitions chamber 33 into first, second, third, and fourth subchambers 35, 37, 39, 41.

Figure 4:
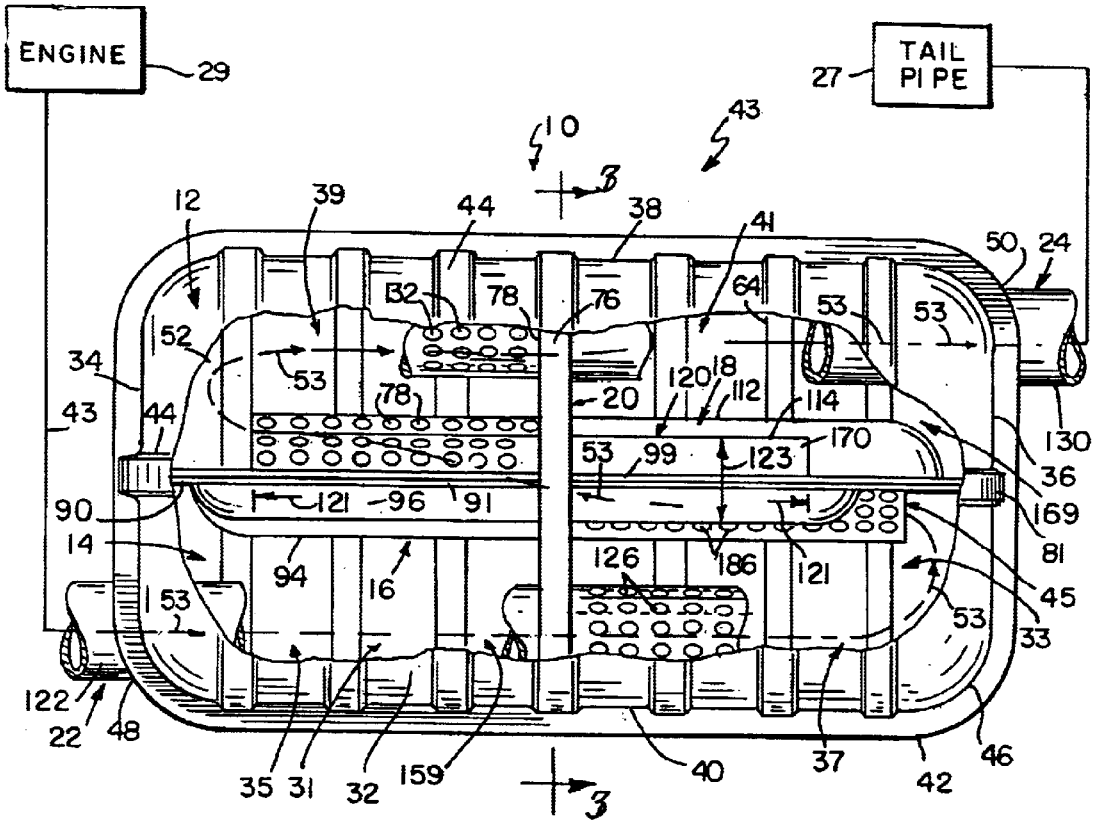
FIG. 4 is a top plan view of the muffler of FIG. 3, with portions of the top outer shell, inlet tube, and outlet tube broken away, showing the top and bottom outer shells cooperating to define a chamber, the vertical first and second inner plates cooperating with the baffle plate to partition the chamber into first, second, third, and fourth subchambers so that the inlet tube receives exhaust gases generated by an engine, communicates the exhaust gas through the lower-left first subchamber, and "dumps" the exhaust gas into the lower-right second subchambers the middle conductor defined by the vertical first and second inner plates communicates the exhaust gases "diagonally" from the second subchamber to the upper-left third subchamber, and the outlet tube communicates the exhaust gases through the upper-right fourth subchamber into the remainder of the exhaust system including a tailpipe.

After assembly, muffler 10 is installed in a vehicle (not shown) as part of an exhaust system 43 as shown diagrammatically in FIG. 4. An engine 29 generates exhaust gas that flows through exhaust system 43 and into inlet tube 22 of muffler 10. Inlet tube 22 communicates exhaust gas through first subchamber 35 into second subchamber 37. First and second vertical inner plates 16, 18 cooperate to define a middle conductor tube 45 that communicates the exhaust gas "diagonally" across muffler 10 from second subchamber 37 to third subchamber 39. Outlet tube 24 then communicates the exhaust gas from third subchamber 39 through fourth subchamber 41 into the remainder of exhaust system 43 including a tail pipe 27 where the exhaust gas is dissipated in the atmosphere.

Muffler 10 is assembled by placing first and second inner plates 16, 18 together, inserting first and second inner plates 16, 18 through a plate-receiving aperture 26 formed in baffle plate 20, and inserting inlet and outlet tubes 22, 24 through respective inlet and outlet tube-receiving apertures 28, 30 formed in baffle plate 20 to create subassembly 31 as shown in FIG. 2. Top and bottom shells 12, 14 cooperate to accept subassembly 31 therebetween and top and bottom shells 12, 14 are welded or otherwise mechanically fastened together to define muffler 10. When top and bottom shells 12, 14 are mated together, they define chamber 33 and secure baffle plate 20, first and second inner plates 16, 18, and inlet and outlet tubes 22, 24 between top and bottom shells 12, 14 as shown in FIGS. 3–7.

Top shell 12 is shaped to include various contours and edges as shown, for example, in FIG. 1. Top shell 12 includes a top wall 32, first and second end walls 34, 36, first and second side walls 38, 40 extending between first and second end walls 34, 36, and a flange 42 appended to side walls 38, 40 and end walls 34, 36 as shown in FIG. 1. First and second end walls 34, 36 and first and second side walls 38, 40 are appended to top wall 32 and extend from top wall 32 to flange 42 at a perimeter edge 46 as shown in FIG. 1. Top wall 32, first and second end walls 34, 36, and first and second side walls 38, 40 are formed to include stiffening ribs 44. In preferred embodiments, ribs 44 raise the resonant frequency of the top shell 12 which reduces the vibration of and noise created by top shell 12. First end wall 34 is formed to include an inlet passageway 48 and second end wall 36 is formed to include an outlet passageway 50 as shown in FIGS. 1 and 4.

Similar to top shell 12, bottom shell 14 is formed to include various contours and edges as shown, for example, in FIG. 1. Bottom shell 14 includes a bottom wall 52, first and second end walls 54, 56, first and second side walls 58, 60 extending between first and second end walls 54, 56, and a flange 62 appended to end walls 54, 56, and side walls 58, 60. First and second end walls 54, 56 and first and second side walls 58, 60 are appended to bottom wall 52 and extend from bottom wall 59 to flange 62 at a perimeter edge 66 as shown, for example, in FIG. 1. Bottom wall 52, first and second end walls 54, 56, and first and second side walls 58, 60 are formed to include stiffening ribs 64. In preferred embodiments, ribs 64 raise the resonant frequency of the bottom shell 14 which reduces the vibration of and noise created by bottom shell 14. First end wall 54 is formed to include an inlet passageway 68 and second end wall 56 is formed to include an outlet passageway 70 as shown in FIGS. 1 and 5.

Baffle plate 20 is formed to include edges and contours to interact with top and bottom shells 12, 14, first and second innerplates 16, 18, and inlet and outlet tubes 22, 24. Baffle plate 20 includes a base 29, a first inner flange 74 defining plate-receiving aperture 26, a second inner flange 71 defining inlet tube-receiving aperture 28, a third inner flange 75 defining outlet tube-receiving aperture 30, and an outer flange 76 at a perimeter edge 78 as shown, for example, in FIGS. 1 and 3. First and second inner plates 16, 18 extend through plate-receiving aperture 26 as shown, for example, in FIG. 2. First and second inner plates 16, 18 are secured to baffle plate 20 by a press-fit with first inner flange 74.

Figure 5:
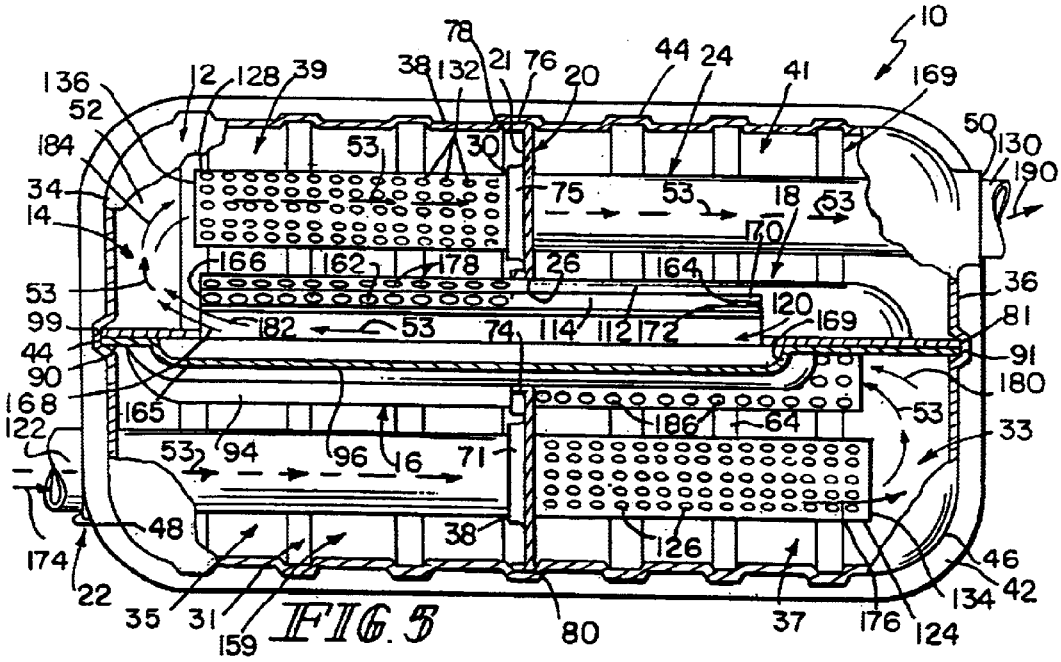
FIG. 5 is a transverse sectional view of the muffler of FIG. 1 taken along lines 5—5 of FIG. 2 and after the installation of the subassembly of FIG. 2 in the chamber defined by the top and bottom outer shells showing the upper tuning throat defined by the vertical first and second inner plates including a first open end communicating with the upper-left third subchamber and a second open end communicating with the upper-right fourth subchamber to permit communication of noise between the third and fourth subchambers so that the fourth subchamber acts as a Helmholtz tuning subchamber.
Figure 6:
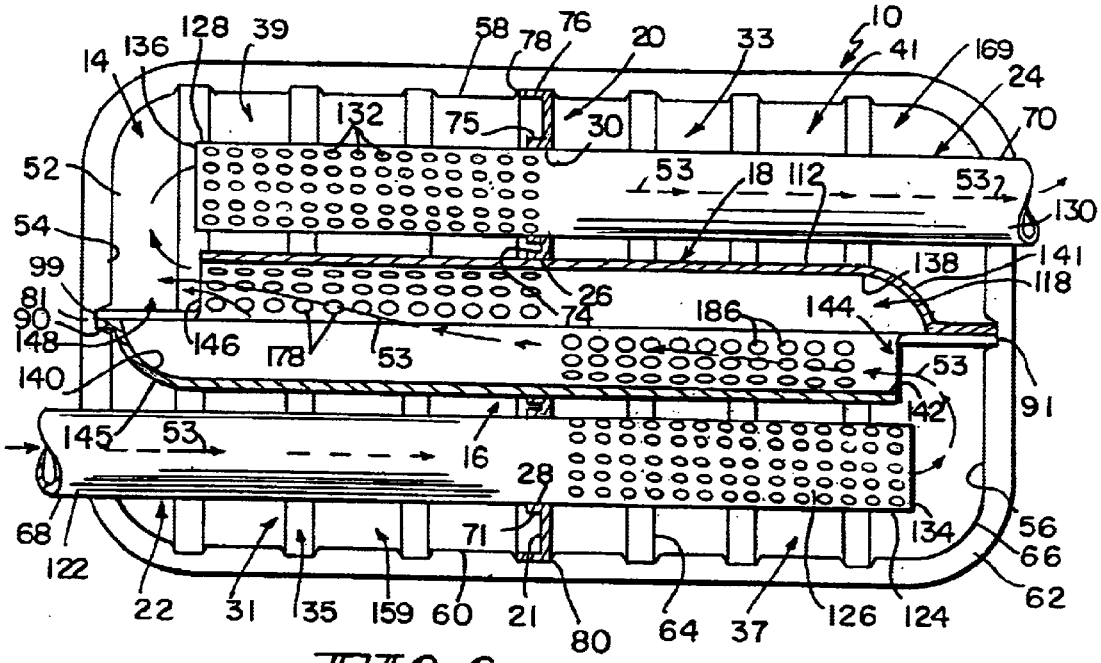
FIG. 6 is a transverse sectional view of the muffler similar to FIG. 5, taken along lines 6—6 of FIG. 2, showing the middle conductor tube defined by the vertical first and second plates including a first opening communicating with the second subchamber and a second opening communicating with the third subchamber so that exhaust gases flow diagonally from the second subchamber to the third subchamber and the second and third subchambers act as first and second transfer subchambers and the middle conductor acts as a conduit therebetween.
Figure 7:
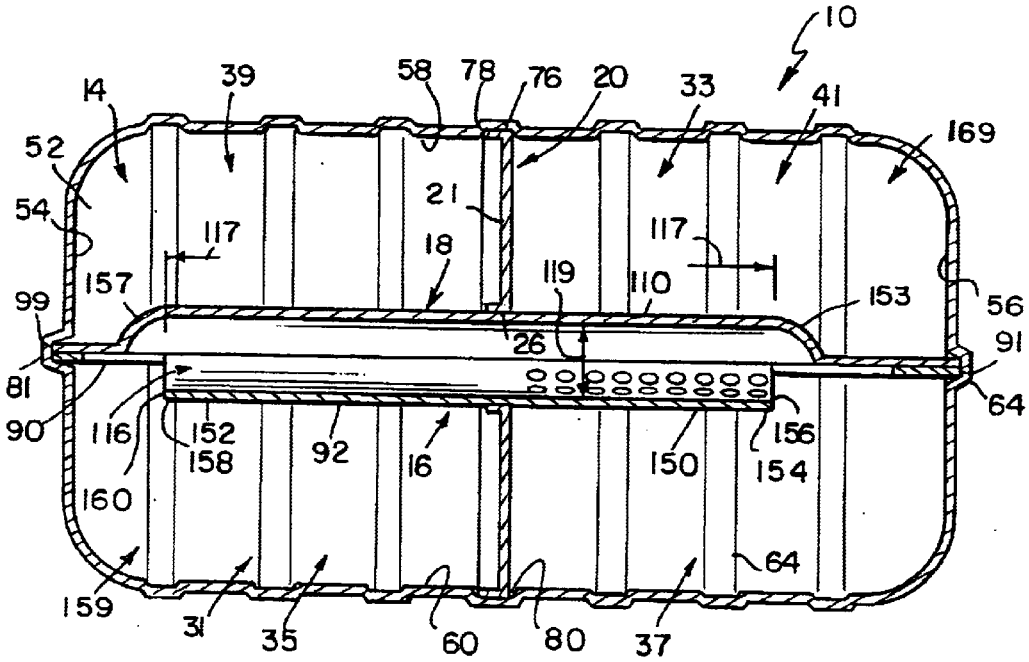
FIG. 7 is a transverse sectional view of the muffler, taken along lines 7—7 of FIG. 2, showing the lower tuning throat defined by the vertical first and second inner plates including a first opening communicating with the second subchamber and a second opening communicating with the first subchamber to permit communication of noise between the second and first subchambers so that the first subchamber acts as a Helmholtz tuning subchamber.

Outer flange 76 of baffle plate 20 engages top and bottom shells 12, 14 as shown in FIGS. 5–7. More specifically, outer flange 76 is positioned to lie in a groove 80 defined by ribs 44, 64 of top and bottom shells 12, 14 as shown, for example, in FIGS. 5–7. In alternative embodiments, the outer flange of the baffle plate may be welded or otherwise coupled to the top and bottom shells. In other alternative embodiments, the outer flange of the baffle plate is not nested in grooves but "free-floats" between the top and bottom shells.

As previously mentioned, baffle plate 20 cooperates with first and second inner plates 16, 18 to divide plate-receiving chamber 33 into first, second, third, and fourth subchambers 35, 37, 39, 41 as shown, for example, in FIG. 4. Subchambers 35, 37, 39, 41 are created without a drawing process being performed on either top wall 32 or bottom wall 52 of top and bottom shells 12, 14, respectively. Top and bottom walls 32, 52 are referred to as creaseless top and bottom walls 32, 52 because no drawing processes are performed on creaseless top and bottom walls 32, 52 to form subcharnbers 35, 37, 39, 41. Stiffening ribs 44, 64 formed on top and bottom walls 32, 52 serve the limited purpose of reducing the vibration of and noise created by top and bottom shells 12, 14 and do not define subchambers between top and bottom shells 12, 14.

Inlet tube 22 includes a first end 122, a second end 124 spaced apart from first end 122, and a plurality of perforations 126. Similarly, outlet tube 24 includes a first end 128, a second end 130 spaced apart from first end 128, and a plurality of perforations 132. Inlet and outlet tubes 22, 24 extend through respective inlet and outlet tube-receiving apertures 28, 30 of baffle plate 20 as shown in FIG. 2. Inlet and outlet tubes 22, 24 are then secured to baffle plate 20 by a press-fit with respective second and third inner flanges 71, 75.

When inlet tube 22 is positioned to lie in chamber 33 defined by top and bottom shells 12, 14, first end 122 of inlet tube 22 is positioned to lie between inlet passageways 48, 68 of top and bottom shells 12, 14. Similarly, second end 130 of outlet tube 24 is positioned to lie between outlet passageways 50, 70 of top and bottom shells 12, 14.

Figure 3:
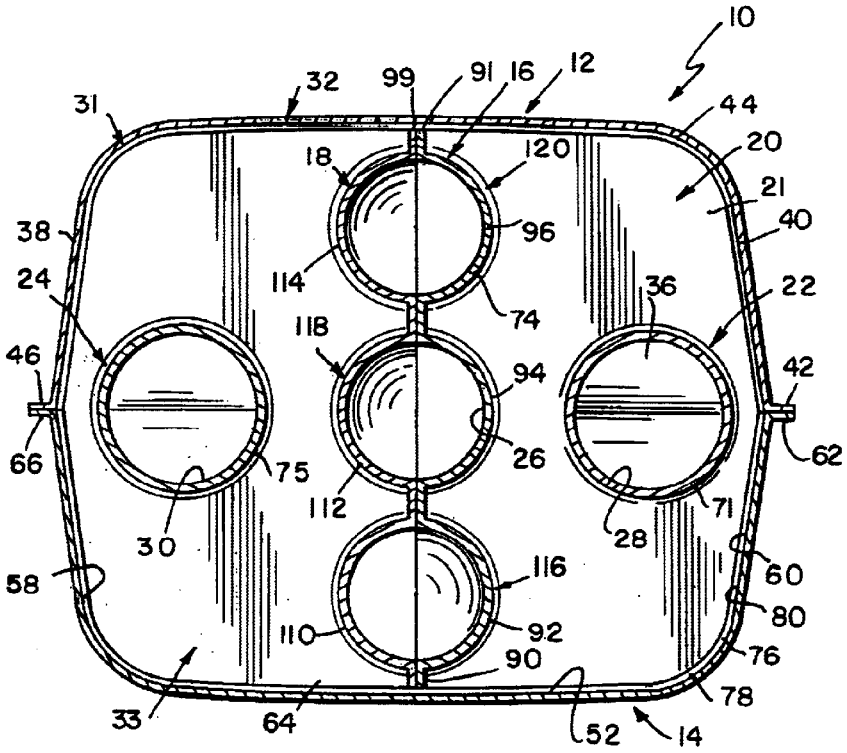
FIG. 3 is a cross-sectional view of the muffler taken along line 3—3 of FIG. 4 after the subassembly of FIG. 2 is positioned between the horizontal top and bottom outer shells showing the baffle plate including a central plate-receiving aperture sized and shaped to receive the vertical first and second inner plates therein after the plates are mated together, an inlet tube-receiving aperture to the right of the central plate-receiving aperture sized to receive the inlet tube, and an outlet tube-receiving aperture to the left of the central plate-receiving aperture sized to receive the outlet tube.

First and second inner plates 16, 18 are stamped from a sheet of stainless steel in the shape as shown in FIGS. 1 and 3. In alternative embodiments, the components of the muffler may be stamped from sheets of cold-rolled, stainless steel, aluminized stainless steel, and any other appropriate type of material. First inner plate 16 includes a base 90 having an outer periphery 91, a first channel 92, a second channel 94, and a third channel 96 as shown, for example, in FIG. 1. Second inner plate 18 is similar to first inner plate 16 and includes a base 98 having an outer periphery 99, a first channel 110, a second channel 112, and a third channel 114 as shown, for example, in FIG. 1.

Outer peripheries 91, 99 are positioned to lie in a groove 81 defined by ribs 44, 64 of top and bottom shells 12, 14 as shown, for example, in FIGS. 5–7. In alternative embodiments, the first and second inner plates include outer flanges (not shown) coupled to the outer peripheries of respective bases and positioned in groove 81.

After first and second inner plates 16, 18 are positioned in plate-receiving aperture 26 of baffle plate 20, a plane defined by bases 90, 98 of first and second inner plates 16, 18 is substantially perpendicular to a plane defined by base 21 of baffle plate 20 as shown in FIG. 4. After positioning subassembly 31 into chamber 33 defined by top and bottom outer shells 12, 14, the plane defined by base 21 of baffle plate 20 is substantially perpendicular to top wall 32 of top outer shell 12 and bottom wall 52 of bottom outer shell 14 and the plane defined by bases 90, 98 of first and second inner plates 16, 18 is substantially perpendicular to top wall 32 of top outer shell 12 and bottom wall 52 of bottom outer shell 14. The respective axes of inlet and outlet tubes 22, 158 are substantially parallel to top wall 32 and bottom wall 52, substantially perpendicular to the plane defined by base 21 of baffle plate 20, and substantially parallel to and spaced apart from the plane defined by bases 90, 98 of first and second inner plates 16, 18.

Inlet tube 22, first and second inner plates 16, 18, and outlet tube 24 cooperate to form a path for exhaust gas to flow through muffler 10. When first and second inner plates 16, 18 mate together, first channels 92, 110 cooperate to define a lower first tuning throat 116 as shown in FIG. 7, second channels 94, 112 cooperate to define a middle tube 118 as shown in FIG. 6, and third channels 96, 114 combine to define an upper second tuning throat 120 as shown in FIG. 5. In preferred embodiments of the present invention, first and second inner plates 16, 18 are connected together by seam welding between and along the length of the respective cooperating channels 92, 110; 94, 112; and 96, 114. As shown in FIG. 3, inlet tube 22, outlet tube 158, and middle tube 118 are coplanar in a horizontal plane defined therethrough and spaced apart from bottom wall 52 of bottom outer shell 14 by a substantially equal vertical distance. First tuning throat 116 is vertically lower than the plane defined by inlet tube 22, outlet tube 158, and middle tube 118. Whereas, second tuning throat 120 is vertically higher than the plane defined by inlet tube 22, outlet tube 158, and middle tube 118.

Exhaust gas flows from first end 122 of inlet tube 22 to second end 130 of outlet tube 24 along a serpentine path 53 through inlet tube 22, tube 118 of vertical first and second inner plates 16, 18, and outlet tube 24 as best shown in FIGS. 4 and 6. Inlet tube 22 is formed to permit communication of exhaust gas from exhaust system 43 to second subchamber 37. Second end 124 of inlet tube 22 is formed to include an opening 134 that communicates with second subchamber 37.

Middle tube 118 of inner plates 16, 18 is formed to permit communication of exhaust gas from second subchamber 37 to third subchamber 39. Tube 118 includes a first end 138 positioned to lie adjacent to second end walls 36, 56 of top and bottom shells 12, 14 and a second end 140 positioned to lie adjacent to first end walls 34, 54 of top and bottom shells 12, 14 as shown, for example, in FIG. 5.

At first end 138 of tube 118, second channel 94 of first inner plate 16 is formed to include an open end 142 that defines an opening 144 through which exhaust gas travels between second subchamber 37 and tube 118. At second end 140 of tube 118, second channel 112 of second inner plate 18 is formed to include an open end 146 that defines an opening 148 through which exhaust gas travels between tube 118 and third subchamber 39. At first end 138 of tube 118, second channel 112 of second inner plate 18 is formed to include a closed end 141 that prevents gas from passing into fourth subchamber 41 from tube 118. Similarly, at second end 140 of tube 118, second channel 94 of first inner plate 16 is formed to include a closed end 145 that prevents gas from passing into first subchamber 35 from tube 118.

Outlet tube 158 is formed to permit communication of exhaust gases from muffler 10 to the remainder of exhaust system 43 including tail pipe 27 as shown in FIG. 4. First end 128 of outlet tube 24 is formed to include an opening 136 that communicates with third subchamber 39 as shown in FIG. 5. Exhaust gas enters outlet tube 158 through opening 136 then exists muffler 10 through second end 130 to the remainder of exhaust system 43.

First tuning throat 116 is formed to permit communication of noise from second subchamber 37 to first subchamber 82 as shown in FIG. 7. First tuning throat 116 includes a first end 150 positioned to lie adjacent to second end walls 36, 56 of top and bottom shells 12, 14 and a second end 152 positioned to lie adjacent to first end walls 34, 54 of top and bottom shells 12, 14.

At first end 150 of first tuning throat 116, first channel 92 of first inner plate 16 is formed to include an open end 154 that defines an opening 156 through which noise enters first tuning throat 116 from second subchamber 37 as shown in FIG. 7. At second end 152 of first tuning throat 116, first channel 92 of first inner plate 16 is formed to include an open end 158 defining an opening 160 through which noise that entered first tuning throat 116 exits into first subchamber 35. At first end 150 of first tuning throat 116, first channel 110 of second inner plate 18 is formed to include a closed end 153 that prevents gas from entering fourth subchamber 41 from first tuning throat 116. At second end 152 of first tuning throat 116, first channel 110 of second inner plate 18 is formed to include a closed end 157 that prevents gas from entering third subchamber 39 from tuning throat 116. Thus, first tuning throat 116 allows low frequency noise to pass from second subchamber 37 into first subchamber 35 so that first subchamber 35 acts as a first Helmholtz tuning subchamber 159 for the attenuation of such low frequency noise.

Second tuning throat 120 is formed to permit communication of noise from third subchamber 39 to fourth subchamber 41 as shown in FIG. 5. Second tuning throat 120 includes a first end 162 positioned to lie adjacent to first end walls 34, 54 of top and bottom shells 12, 14 and a second end 164 positioned to lie adjacent to second end walls 36, 56 of top and bottom shells 12, 14.

At first end 162 of second tuning throat 120, third channel 114 of second inner plate 18 is formed to include an open end 166 that defines an opening 168 through which noise enters second tuning throat 120 from third subchamber 39. At second end 164 of second tuning throat 120, third channel 114 of second inner plate 18 is formed to include an open end 170 defining an opening 172 through which noise that entered second tuning throat 120 exits into fourth subchamber 41. At first end 162 of second tuning throat 120, third channel 96 of first inner plate 16 is formed to include a closed end 165 that prevents gas from entering first subchamber 35 from second tuning throat 120. At second end 164 of second tuning throat 120, third channel 96 of first inner plate 16 is formed to include a closed end 169 that prevents gas from entering second subchamber 37 from second tuning throat 120. Thus, second tuning throat 120 allows low frequency noise to pass from third subchamber 39 into fourth subchamber 41 so that fourth subchamber 41 acts as a second Helmholtz tuning subchamber 161 for the attenuation of such low frequency noise.

First and second tuning throats 116, 120 having respective lengths 117, 121 and inside diameters 119, 123 as shown in FIGS. 7 and 4. Lengths 117, 121 and inside diameters 119, 123 are selected to attenuate a specific range of frequencies. Length 117 and inside diameter 119 of first tuning throat 116 may be the same or different than respective length 121 and diameter 123 of second tuning throat 120.

Exhaust gas travels through muffler 10 along serpentine path 53 until it exits muffler 10. Exhaust gas enters muffler 10 through first end 122 of inlet tube 22 in direction 174 as shown in FIG. 5. Exhaust gas flows through inlet tube 22 and exits inlet tube 22 in direction 176 through opening 134 into second subchamber 37. Inlet tube 22 is formed to include perforations 126 through which exhaust gas in inlet tube 22 also communicates with second subchamber 37. Perforations attenuate high frequency noise and aid in "tuning" the muffler. As previously mentioned, first tuning throat 116 permits exhaust gas to communicate between second subchamber 37 and first subchamber 35.

Exhaust gas continues flowing in direction 180 from second subchamber 37 through opening 144 of tube 118 as shown in FIG. 5. Exhaust gas flows diagonally through middle tube 118 and exits tube 118 in direction 182 through opening 168 into third subchamber 34 as shown in FIG. 5. A portion of tube 118 lying in second subchamber 84 is formed to include a plurality of perforations 186 through which exhaust gas in inlet tube 22 communicates with second subchamber 37. A portion of tube 118 lying in third subchamber 88 is formed to include perforations 178 through which exhaust gas also communicates with third subchamber 39.

Exhaust gas exits third subchamber 39 in direction 184 through opening 136 into outlet tube 24 as shown in FIG. 5. Outlet tube 24 is formed to include perforations 132 through which exhaust gas in outlet tube 24 communicates with third subchamber 39. As previously mentioned, second tuning throat 120 permits exhaust gas to communicate between third subchamber 39 and fourth subchamber 41.

Exhaust gas then exits muffler 10 in direction 190 through second end 130 of outlet tube 24 as shown in FIG. 5 into the remainder of exhaust system 43. In alternative embodiments of the present invention, the inlet tube, outlet tube, and the tube may be formed to include louvers (not shown) instead of perforations.

Although the invention has been described in detail with reference to certain embodiments, variations and modifications exist within the scope and spirit of the invention as described and defined in the following claims.

What is claimed is:

1. A muffler comprising an outer shell defining a chamber internally thereof and including a top wall, a baffle extending across the chamber defined by the outer shell, the baffle including an inner plate aperture, a pair of inner plates positioned to lie in the inner plate aperture of the baffle, each of the inner plates including a base, the bases of the inner plates defining a plane that is generally perpendicular to the top wall of the outer shell, and wherein the baffle and the inner plates cooperate to partition the chamber into subchambers.

2. The muffler of claim 1, wherein the outer shell includes a top wall and the baffle includes a base which lies in a plane that is perpendicular to the top wall of the outer shell.

3. The muffler of claim 1, wherein the inner plates abut one another in part and define a passageway therebetween, which passageway extends between two subchambers.

4. The muffler of claim 3, wherein the inner plates define at least one tuning chamber between the plates and wherein the tuning chamber extends between two subchambers.

5. The muffler of claim 1, wherein the inner plates define at least one tuning chamber between the plates and wherein the tuning chamber extends between two subchambers.

6. The muffler of claim 1, wherein an inlet pipe and an outlet pipe extend into the chamber from outside the outer shell and are each located in separate additional apertures in the baffle.

7. The muffler of claim 3, wherein an inlet pipe and an outlet pipe extend into the chamber from outside the outer shell and are each located in separate additional apertures in the baffle.

8. The muffler of claim 5, wherein an inlet pipe and an outlet pipe extend into the chamber from outside the outer shell and are each located in separate additional apertures in the baffle.

9. A muffler comprising an outer shell defining a chamber internally therein, a baffle extending across the chamber defined by the outer shell, the baffle including an inlet aperture, an inner plate aperture, and an outlet aperture, an pair of inner plates positioned to lie in the inner plate aperture, an inlet tube positioned to lie in the inlet aperture of the baffle, and an outlet tube positioned to lie in the outlet aperture of the baffle.

10. The muffler of claim 9, wherein the outer shell includes a top wall and the baffle includes a base which lies in a plane that is perpendicular to the top wall of the outer shell.

11. The muffler of claim 9, wherein the outer shell includes a top wall and each of the inner plates includes a base which lies in a plane that is perpendicular to the top wall of the outer shell.

12. The muffler of claim 9, wherein the pair of inner plates cooperate with the baffle to partition the chamber into subchambers.

13. The muffler of claim 12, wherein the inlet and outlet tubes are spaced part from the pair of inner plates.

14. The muffler of claim 9, wherein the pair of inner plates define first, second, and third tubes, one of the first, second, and third tubes is substantially coplanar with the inlet and outlet tubes, and the other of the first, second, and third tubes are spaced apart from the plane defined by the inlet and outlet tubes.

15. The muffler of claim 9, wherein the inner plates abut one another in part and define a passageway therebetween, which passageway extends between two subchambers.

16. The muffler of claim 15, wherein the inner plates define at least one tuning chamber between the plates and wherein the tuning chamber extends between two subchambers.

17. The muffler of claim 9, wherein the inner plates define at least one tuning chamber between the plates and wherein the tuning chamber extends between two subchambers.

18. A muffler comprising an outer shell defining a chamber internally thereof, a baffle extending across the chamber defined by the outer shell, the baffle including an inner edge defining an inner plate aperture, and a pair of inner plates cooperating to form a first tube, a second tube, and a third tube, the first, second, and third tubes being positioned to lie in the inner plate aperture and being spaced apart from the outer shell.

19. The muffler of claim 18, wherein the inner edge of the baffle includes a first edge defining a first opening, a second edge defining a second opening, and a third edge defining a third opening, the first, second, and third edges are positioned to lie in spaced-apart relation, and the first, second, and third tubes are positioned to lie in the first, second, and third openings, respectively.

20. The muffler of claim 19, wherein the first, second, and third edges substantially circumferentially surround the first, second, and third tubes, respectively.

21. The muffler of claim 20, wherein the first, second, and third edges are substantially circular-shaped.

22. The muffler of claim 19, wherein the baffle circumferentially surrounds the inner plates.

23. The muffler of claim 18, wherein the baffle and the inner plates cooperate to partition the chamber into a first subchamber, a second subchamber, a third subchamber, and a fourth subchamber, the first and second subchambers communicate with each other through the first tube, the second and third subchambers communicate with each other through the second tube, and the third and fourth subchambers communicate with each other through the third tube.

24. The muffler of claim 18, wherein the first, second, and third tubes are positioned to lie in spaced-apart, parallel relation, the second tube is positioned to lie above the first tube, and the third tube is positioned to lie above the second tube.

25. A muffler comprising an outer shell defining a chamber internally therein, a baffle positioned to lie in the chamber and including a perimeter edge and an inner edge defining an inner plate aperture, the perimeter edge of the baffle abutting the outer shell along the entire length of the perimeter edge of the baffle, and a pair of inner plates positioned to lie in the inner plate aperture of the baffle to partition the chamber into subchambers.

26. The muffler of claim 25, wherein the perimeter edge of the baffle is spaced-apart from the inner plates.

27. The muffler of claim 25, wherein the inner edge of the baffle circumferentially surrounds the inner plates.

28. The muffler of claim 25, wherein the outer shell includes a top shell and a bottom shell coupled to the top shell to form the chamber, and the perimeter edge abuts the top shell and the bottom shell.

* * * * *